US005255057A

United States Patent [19]

Stelter et al.

[11] Patent Number: 5,255,057

[45] Date of Patent: Oct. 19, 1993

[54] GRAY SCALE MONOCOMPONENT NONMAGNETIC DEVELOPMENT SYSTEM

[75] Inventors: Eric C. Stelter, Rochester; Joseph E. Guth, Holley; William Vreeland, Webster; Thomas A. Jadwin, Rochester, all of N.Y.

[73] Assignee: Eastman Kodak Company, Rochester, N.Y.

[21] Appl. No.: 891,372

[22] Filed: May 29, 1992

[51] Int. Cl.[5] ..... G03G 15/08

[52] U.S. Cl. ..... 355/246; 118/653; 355/251; 355/253; 430/110

[58] Field of Search ..... 355/246, 259, 245, 251, 355/253; 118/651, 653; 430/106.6, 110, 109, 120, 102

[56] References Cited

U.S. PATENT DOCUMENTS

| | | | |
|---|---|---|---|
| 4,100,884 | 7/1978 | Mochizuki et al. | 118/653 |
| 4,286,543 | 9/1981 | Ohnuma et al. | 118/657 |
| 4,395,110 | 7/1983 | Hosono et al. | 118/657 X |
| 4,445,771 | 5/1984 | Sakamoto et al. | 118/657 X |
| 4,450,220 | 5/1984 | Haneda et al. | 430/102 |
| 4,459,009 | 7/1984 | Hays et al. | 430/120 X |
| 4,528,936 | 7/1985 | Shimazaki et al. | 118/653 |
| 4,561,381 | 12/1985 | Kaneko et al. | 118/652 |
| 4,563,076 | 1/1986 | Takahashi et al. | 361/229 X |
| 4,575,218 | 3/1986 | Sakamoto et al. | 118/657 X |
| 4,576,463 | 3/1986 | Sakamoto et al. | 118/657 X |
| 4,586,460 | 5/1986 | Kohyama et al. | 118/653 |
| 4,607,939 | 8/1986 | Saito . | |
| 4,653,426 | 3/1987 | Kohyama | 118/651 |
| 4,675,267 | 6/1987 | Haneda et al. | 430/102 |
| 4,696,255 | 9/1987 | Yano et al. | 118/653 |
| 4,707,382 | 11/1987 | Tajima et al. | 427/58 |
| 4,710,015 | 12/1987 | Takeda et al. | 118/651 X |
| 4,743,937 | 5/1988 | Martin . | |
| 4,760,422 | 7/1988 | Seimiya et al. | 118/656 X |
| 4,764,841 | 8/1988 | Brewington et al. | 361/226 |
| 4,774,541 | 9/1988 | Martin et al. | 118/653 X |
| 4,903,634 | 2/1990 | Ono et al. | 118/653 |
| 4,977,054 | 12/1990 | Honjo et al. | 430/108 |
| 4,985,328 | 1/1991 | Kumagai et al. | 430/110 |
| 4,990,424 | 2/1991 | Van Dusen et al. | 430/106.6 |
| 5,012,285 | 4/1991 | Oka et al. | 355/245 |
| 5,013,628 | 5/1991 | Kok et al. | 430/110 |
| 5,034,775 | 7/1991 | Folkins | 355/259 |
| 5,038,710 | 8/1991 | Kagayama et al. | 118/653 |
| 5,041,351 | 8/1991 | Kitamori et al. | 430/106.6 |
| 5,043,239 | 8/1991 | Kukimoto | 430/100 |
| 5,132,735 | 7/1992 | Howland | 355/261 |

FOREIGN PATENT DOCUMENTS

| | | | |
|---|---|---|---|
| 241160A2 | 10/1987 | European Pat. Off. | 430/120 |
| 205178B1 | 4/1991 | European Pat. Off. | 355/259 |
| 2163371B | 4/1988 | United Kingdom . | |
| 2197227A | 5/1988 | United Kingdom . | |

OTHER PUBLICATIONS

H. Sato et al., Oki Electric Industry Co., Ltd., "Contact Development With Nonmagnetic Monocomponent Toner", The Sixth International Congress on Advances in Non-Impact Printing Technologies, The Society for Imaging Science and Technology, Springfield, Va. 1990, pp. 76-77 (Advance Printing Paper Summaries).

A. Shinozaki et al., Ricoh Co., Ltd., "Influence of Electric Characteristics of Development Roller Used in Non-magnetic Single-Component and Contact Development Process", ibid., p. 10 (Advance Printing of Paper Summaries), and pp. 55-61 (full text).

J. A. Thompson, IBM Corp., "A Review Of The Development Process Technology Utilized In The IBM Laser Printer Family", ibid., pp. 11-12 (Advance Printing Paper Summaries), and pp. 72-84 (full text).

M. Lee et al., IBM Corp., "Charge Distribution Of Toner In Jump Development", ibid, p. 75 (Advance Printing of Paper Summaries), and pp. 196-206 (full text).

H. Yamamoto et al., Matsushita Electric Industrial Co., Ltd., "Novel Color Electrophotography: 'One Drum Color Superimposing Process'", The Fifth International Congress on Advances in Non-Impact Printing Technologies—Proceedings, The Society for Imaging Science and Technology, Springfield, Va., 1990, pp. 115-128.

Matsushita Electric Industrial Co., Ltd., Panasonic FP-C1 Service Manual, Section IV (undated), pp. 4-17 and 4-07.

K. Sakamoto et al., Ricoh Co., Ltd., "Design Of Electrostatic Fields In A New Mono-Component System", IEEE, CH2207-9/85, IAS85;48E, 1985, pp. 1502-1509.

*Primary Examiner*—R. L. Moses
*Assistant Examiner*—T. A. Dang
*Attorney, Agent, or Firm*—Irwin Ostroff; Peter J. Franco; Willard G. Montgomery

[57] ABSTRACT

An electrostatic latent image on a photoconductor of an electrophotographic device is developed by a gray scale monocomponent nonmagnetic development system using a combination of AC and DC bias voltages applied to a developer roller and a monocomponent nonmagnetic developer applied to the developer roller by an adder roller. The developer comprises a mixture of toner particles charged to one polarity and transparent beads charged to the opposite polarity, by triboelectric charging in bulk in an alternating field between the two rollers, rather than by friction contact with apparatus surfaces. The adder roller applies the charged mixture to the developer roller for developing the latent image in an electric field to an image density determined by the magnitude of the DC bias. A DC bias may be applied to the adder roller, especially to provide a gradient relative to the DC component of the developer roller bias for driving the bulk charged mixture onto the developer roller. A doctor blade is usable to smooth the toner into a selective thickness layer on the developer roller. The developer roller may have an uncoated semiconductive surface layer, or one covered by a nonconductive coating. The system provides greater uniformity of triboelectrical charging and reduced sensitivity to surface contamination.

33 Claims, 3 Drawing Sheets

GRAY SCALE MONOCOMPONENT NONMAGNETIC DEVELOPMENT SYSTEM

FIELD OF THE INVENTION

This invention relates to a gray scale monocomponent nonmagnetic development system including an apparatus and method for developing an electrostatographic (electrostatic) latent image in an electrophotographic device.

BACKGROUND OF THE INVENTION

Current day use of monocomponent nonmagnetic development systems in electrophotographic devices is exemplified by the following publication items:

[1] H. Sato et al., Oki Electric Industry Co., Ltd., "Contact Development With Nonmagnetic Monocomponent Toner," The Sixth International Congress on Advances in Non-Impact Printing Technologies, The Society for Imaging Science and Technology, Springfield, Va., 1990, pp. 76–77 (Advance Printing of Paper Summaries);

[2] A. Shinozaki et al., Ricoh Co., Ltd., "Influence Of Electric Characteristics Of Development Roller Used In Non-magnetic Single-Component and Contact Development Process," ibid., p. 10 (Advance Printing of Paper Summaries), and pp. 55–61 (full text);

[3] J. A. Thompson, IBM Corp., "A Review Of The Development Process Technology Utilized In The IBM LaserPrinter Family," ibid., pp. 11–12 (Advance Printing of Paper Summaries), and pp. 72–84 (full text);

[4] M. Lee et al., IBM Corp., "Charge Distribution Of Toner In Jump Development," ibid, p. 75 (Advance Printing of Paper Summaries), and pp. 196–206 (full text);

[5] H. Yamamoto et al, Matsushita Electric Industrial Co., Ltd., "Novel Color Electrophotography: 'One Drum Color Superimposing Process'," The Fifth International Congress on Advances in Non-Impact Printing Technologies—Proceedings, The Society for Imaging Science and Technology, Springfield, Va., 1990, pp. 115–128; and

[6] Matsushita Electric Industrial Co., Ltd., Panasonic FP-C1 Service Manual, Section IV (undated), pp. 4-17 and 4-07.

In a typical electrophotographic device using monocomponent nonmagnetic developer (toner) to develop an electrostatographic (electrostatic) latent image on a photosensitive surface of a photoconductor (drum), a toner adder roller (foam roller or brush roller) applies the toner to a developer roller (sleeve) and a doctor blade smooths it into a thin layer for transfer to the photosensitive surface to develop the latent image. Friction contact with various surfaces including the adder roller, developer roller and doctor blade is required to charge the toner triboelectrically to develop the latent image.

This technology is primarily used in black-only devices such as laser printers However, there is great interest in using monocomponent nonmagnetic development for low-cost color printers.

One typical development system, as disclosed in item [1] above, uses a conductive elastomeric developer roller having a non-conductive outer coating. Toner is applied onto this developer roller by a foam type toner-adder roller. A regulation (doctor) blade in contact with the developer roller smooths the resulting layer of applied toner. The image is developed with the developer roller in contact with the photoconductor.

Similar development systems are used for non-contact development, as disclosed in items [4], [5] and [6] above. These systems have a conductive, nonmagnetic, metallic developer roller spaced a few mils from the photoconductor.

Item [2] above concerns a so-called particle electrode developer roller (sleeve) having a conductive rubber substrate coated with a carbon or other particle containing insulating layer (electrically isolated electrode particles or carrier particles in a non-conductive resin matrix, i.e., floating electrodes).

In the IBM Model 4019 laser printer (IBM 4019), which is similar to that disclosed in item [1] above, the toner is charged negatively by triboelectric charging against the non-conductive coating of the developer roller. It is also charged by negative DC bias voltages on the conductive foam toner adder roller and metal doctor blade used in this device. The toner is held to the developer roller by attraction to triboelectric charges on the developer roller surface, image charges, surface charges and toner adhesion, until development of the latent image occurs (item [3] above).

In particular, item [3] above reviews the operation of an IBM laser printer (assumably the IBM 4019) with contact developing of nonmagnetic thermoplastic (insulative) toner only on the discharged latent image area of a drum type photoconductor. The developer unit includes an adder roller and doctor blade each in friction contact with an elastic semiconductive developer roller.

The adder roller has an open cell urethane foam substrate of 40 pores/inch, overcoated with a conductive layer to yield a low bulk resistivity of about $10^4$ ohm cm or less, on which toner deposits. The adder roller runs at about 2.5 times the print speed for charging the toner against the developer roller and creating a countercharge on the developer roller causing toner to adhere thereto. A DC bias is applied to the adder roller which is 100 VDC more negative than the DC voltage applied to the developer roller, to aid toner loading and friction charging on the developer roller as well as discharging of residual charge after image development.

The doctor blade has a surface treated with tungsten carbide particles and is held under an 800 gram (34.5 g/cm) force to form a monolayer of toner on the developer roller and add charges of the desired polarity to the toner layer. A DC bias is applied to the doctor blade which is 325 VDC more negative than the DC voltage applied to the developer roller.

The developer roller has a 6 mm thick nitrile rubber, elastic layer of about $10^9$ ohm cm resistivity and 45 Shore A hardness, overcoated with a 50 micron thick polyurethane (insulating) outer coating which is triboelectrically active with the toner. The elastic semiconductive developer roller acts like the carrier particles in a two-component developer of toner and carrier.

All monocomponent nonmagnetic development systems offer the advantage of no toner concentration monitor, no carrier pick-up onto the photosensitive surface (film) of the photoconductor, and no carrier aging or replenishment concerns, as are common in two component development systems, i.e., using a particle mixture of toner and carrier. Monocomponent nonmagnetic development technique is attractive for low cost color printers as there is no magnetic material in the toner to interfere with color applications. However, for triboelectrically charging the toner, the prior art relies on contact with the doctor blade and the developer roller surface, and to some extent on contact with the toner adder roller.

Triboelectric charging by contact with adjacent surfaces makes the process sensitive to surface contamination, e.g., toner scumming, which adversely affects performance. Scumming is the permanent adhesion of fine toner particles to the developer roller and doctor blade due to frictional contact during triboelectric charging of the toner and leads to image quality defects.

Triboelectric charging of toner by contact with adjacent surfaces also limits the system to either a thin layer of toner on a developer roller running at modest speed, or poor control of charging which results in a broad toner charge to mass ratio (Q/M) distribution, deposition of toner in image background areas, and cleaning problems. Moreover, in the case of the IBM 4019 laser printer, the non-conductive developer roller surface, which is used for triboelectrically charging the toner, itself becomes charged and must be discharged after development occurs.

For development with the developer roller in contact with the photoconductor, as disclosed in item [1] above, background toner deposition can be reduced if the roller surface (peripheral) speed is faster than the photoconductor surface speed In the IBM 4019 laser printer, which uses contact development, the developer roller surface speed is about 1.5 times that of the photoconductor.

Additional problems occur if this development process is used to print gray scales, high density solid areas on light density backgrounds, or black on gray images, as required for a color printer. Particular problems involve:

(a) White halo surrounding black solids on gray backgrounds.

(b) Dark fringe or edge development of gray solids on white backgrounds, caused by image fringe fields with contributions from changes in developer roller polarization at solid area edges.

(c) Double printing of black images in gray backgrounds, as a result of differential speed contact development, e.g., a 1.5:1 developer roller to photoconductor surface speed ratio. This causes high charge to mass (Q/M) toner on the developer roller to develop first, and low charge to mass remainder toner to develop background gray areas after the developer roller advances from a black area to an undeveloped gray region of the latent image.

(d) High contrast reflection density (Dr) versus development potential characteristics, as caused by cooperative development due to toner cohesion. If one toner particle develops, others follow (item [4] above).

Development potential (delta V) is the voltage difference between the DC voltage of the photoconductor latent image and that applied to the developer roller, i.e., the photoconductor latent image voltage minus the developer roller voltage.

Because of these problems, the prior art cannot provide an effective gray level, or continuous tone color, printer, e.g. a laser printer, for monocomponent nonmagnetic developer systems.

It is noted that in discharge area development (DAD), as used in laser printers, the charge on the latent image area is discharged while the image background area remains charged, and the toner is charged to the same polarity as the background area, being repelled therefrom and attracted to the discharged latent image. Conversely, in charge area development (CAD), as used in electrophotographic copying machines, the charge on the background area is discharged while the latent image remains charged, and the toner is charged to the opposite polarity to that of the latent image, being preferentially attracted to the latent image.

Examples of systems for developing an electrostatic latent image are shown in the following prior art.

U.S. Pat. No. 4,450,220 (Haneda et al.) and its division U.S. Pat. No. 4,675,267 concern cloud charging of nonmagnetic or magnetic toner, or two component developer, in an AC field between a developer roller as one electrode and a fixed plate as the other electrode, each under an AC, and optionally a DC, bias. Toner is charged at least in part by alternately impinging against the electrodes, and deposits on the developer roller for non-contact developing. The nonmagnetic toner may be blended with silica powder, and the carrier of the two component developer may be insulating material such as glass beads.

U.S. Pat. No. 5,034,775 (Folkins) concerns applying two component magnetic developer to a magnetic developer roller under a DC bias for powder cloud developing. Toner is attracted from the developer roller to a spaced donor roller under a higher DC bias, for transfer to the photoconductor via a gap having powder cloud generating electrodes under a low AC bias. The electrode AC bias provides an alternating field with the donor roller to form the cloud, and the donor roller DC bias provides an electrostatic field with the photoconductor to attract toner thereto.

The following prior art concerns developer units that do not include an adder roller.

U.S. Pat. No. 5,041,351 (Kitamori et al.) concerns use as a monocomponent magnetic developer of a mixture of negatively chargeable magnetic toner particles, positively chargeable fine resin particles such as polymethylmethacrylate (PMMA), and negatively chargeable silica powder. The mixture is applied to a magnetic developer sleeve for non-contact developing under an AC bias applied between the sleeve and photoconductor.

U.S. Pat. No. 4,653,426 (Kohyama et al.) discloses applying magnetic toner or two component developer to a developer roller for non-contact developing of various size and charge level toner particles, under a developer roller DC bias and cyclically varying multiple frequency AC bias.

U.S. Pat. No. 4,528,936 (Shimazaki et al.) and U.S. Pat. No. 4,586,460 (Kahyama et al.) disclose applying nonmagnetic toner, optionally with a flow improver, to a developer roller for non-contact developing, optionally under a developer roller DC or AC bias.

U.S. Pat. No. 4,395,110 (Hosono et al.) discloses applying nonmagnetic or magnetic toner, optionally mixed with silica particles, to a developer roller for non. contact developing under a DC and AC bias applied between the roller and photoconductor.

U.S. Pat. No. 5,043,239 (Kokimoto et al.) concerns use as a monocomponent magnetic developer of a mixture of negatively chargeable magnetic toner particles and treated silica powder. The mixture is applied to a developer sleeve containing a magnet, and used for reversal developing under an AC and DC bias applied between the sleeve and photoconductor.

U.S. Pat. No. 4,100,884 (Mochizuki et al.) discloses applying nonmagnetic or magnetic toner to a developer roller and forming it into a layer by a doctor blade, per friction contact charging or use of a scorotron charger. Non-contact developing is effected under a bias voltage applied via a switch to the developer roller. The roller has a coating of one type for positively charging the toner and another for negatively charging the toner.

The following prior art concerns developer units that do include an adder roller.

European Application No. 241,160 A2 (Shinya et al.) discloses applying nonmagnetic toner by an unidentified member, assumably an adder roller, to a developer roller for non-contact developing under a developer roller DC and/or AC bias. The toner is a positively chargeable resin, surface treated with a silane agent.

U.S. Pat. No. 4,903,634 (Ono et al.) and its counterpart European Patent No. 205,178 B1 disclose applying nonmagnetic or magnetic toner by an adder roller, against which the toner supply is loaded, to a developer roller for non-contact developing under a developer roller DC bias. The adder roller is under a DC, or a DC and AC, bias, and contacts the developer roller, an excess toner removing plate, and the unit wall, for charging the toner.

U.S. Pat. No. 5,012,285 (Oku et al.) discloses applying monocomponent or two component magnetic developer by an adder roller to a developer sleeve containing a magnet, and forming it into a layer by an agitating doctor blade. Non-contact developing occurs under a sleeve DC bias, with the adder roller being spaced from the sleeve and under a DC and AC bias.

U.S. Pat. No. 4,286,543 (Ohnuma et al.) discloses applying nonmagnetic or magnetic toner or two component developer, to a developer roller and forming it into a layer by a doctor blade. The developer roller is under a DC bias of opposite polarity to the toner, and the doctor blade is under a different DC bias of the same polarity as the toner. Optionally, the toner or developer is applied to an adder roller, formed into a layer by the doctor blade, and then transferred to the developer roller. The developer roller has a conductive coating optionally overcoated with an insulating outer coating, and has a magnet for magnetic brush development when using a magnetic toner or developer. Contact development is effected under the developer roller DC bias.

British Application No. 2,197,227 A (Hirano et al.) discloses applying nonmagnetic or magnetic toner associated with silica or other "metal" oxide, by an adder roller to a developer roller. It is formed into a layer by a silica filled silicone rubber doctor blade for contact developing. The metal oxide of the toner is adsorbed on the doctor blade to inhibit toner fusion thereto.

U.S. Pat. No. 4,760,422 (Seimiya et al.) discloses applying nonmagnetic toner, optionally containing a flow improving inorganic powder, to a particle electrode developer sleeve. For contact developing, the sleeve is under a DC bias, and for non-contact developing it is under a pulse voltage, or an AC, or AC and DC, bias, the AC having a smaller amplitude than the gap distance between the sleeve and photoconductor.

U.S. Pat. No. 4,696,255 (Yano et al.) and analogous British Patent No. 2,163,371 B (Demizu et al.) disclose applying nonmagnetic toner by an adder roller to a particle electrode developer sleeve. It is formed into a layer by a doctor blade and effects developing under a sleeve voltage bias. The sleeve has a particle electrode-containing insulating layer of a resin spaced in the triboelectric series from the toner for charging the toner relative to the adder roller and doctor blade.

U.S. Pat. No. 4,445,771 (Sakamoto et al.), and its divisions U.S. Pat. No. 4,575,218 and U.S. Pat. No. 4,576,463, disclose applying magnetic toner by a magnetic adder sleeve to a particle electrode developer sleeve, and forming it into a layer by a doctor blade, under magnetic brush charging. Contact or non-contact developing is effected under a developer sleeve voltage bias to prevent toner deposition on the image background area, or under friction charging of the developer sleeve to the same polarity as the background area for the same purpose. For nonmagnetic toner, the adder sleeve is omitted.

U.S. Pat. No. 4,710,015 (Takeda et al.) discloses applying nonmagnetic or magnetic toner by an adder roller to a particle electrode developer roller for contact developing under a developer roller voltage bias. The particle electrode layer on the developer roller is overcoated with an insulating outer coating.

U.S. Pat. No. 4,459,009 (Hays et al.) discloses gravity flow of nonmagnetic insulating toner between an adder roller and developer roller, both of opposite polarity to the toner, the adder roller having a triboelectrically active coating of such opposite polarity. A layer of toner forms on the developer roller that spaces the two rollers. Contact developing occurs under an adder roller bias of the same polarity as the toner, e.g., +100 VDC, and an opposite polarity developer roller bias, e.g., −250 VDC, at an opposite polarity latent image charge, e.g., −500 VDC, and opposite polarity background area discharge level, e.g., −100 VDC.

U.S. Pat. No. 4,764,841 (Brewington et al.), which is related to said U.S. Pat. No. 4,459,009, concerns alternative gravity flow of the nonmagnetic toner directly onto a developer roller having a triboelectrically active coating of such opposite polarity. Contact developing occurs under a developer roller DC bias, and where an adder roller is optionally also used as in said U.S. Pat. No. 4,459,009, under another DC bias applied thereto.

U.S. Pat. No. 4,743,937 (Martin et al.) discloses applying nonmagnetic toner by an adder brush to a developer roller, both having triboelectrically active surface material of opposite polarity to the toner. A layer of toner is formed on the developer roller by a doctor blade optionally also of such triboelectrically active material. Contact developing of a latent image of such opposite polarity is effected under a developer roller DC bias and optionally a brush DC bias.

U.S. Pat. No. 4,774,541 (Martin et al.) discloses a unit like that of said U.S. Pat. No. 4,743,937, but with a cage roller of triboelectrically active material instead of a brush.

It is desirable to provide a gray scale monocomponent nonmagnetic development system for an electrophotographic device, e.g., a laser printer, effective for gray level or continuous tone contact or non-contact developing of the latent image in black and/or color printing, with a developer roller having a semiconductive layer, either coated with a non-conductive outer coating or uncoated.

SUMMARY OF THE INVENTION

The foregoing drawbacks of prior art monocomponent nonmagnetic development systems have been obviated in accordance with this invention by providing a gray scale monocomponent nonmagnetic development system using a combination of AC and DC bias voltages and a specific monocomponent nonmagnetic developer (toner).

The toner comprises a mixture of toner particles chargeable to one polarity and transparent counterpart charging beads chargeable to the opposite polarity. The mixture (monocomponent nonmagnetic toner) is triboelectrically charged in bulk, in an alternating field produced by the AC component of the bias voltage, between developer means and applying means, substantially independently of friction contact of the mixture with adjacent surfaces. The charged mixture is applied by the applying means to the developer means for developing an electrostatographic (electrostatic) latent image on a photoconductor to a selective image density, in an electric field produced by the DC component of the bias voltage.

The system comprises developer means, applying means and voltage means arranged for applying the AC and DC bias to the developer means, for use with the mixture (developer, toner) which may have, e.g., negatively chargeable, toner particles and, e.g., positively chargeable, small transparent beads.

Typically, the developer means is an electrically biasable developer roller (sleeve), especially one with a conductive substrate covered by a resilient carrier surface comprising a semiconductive layer, e.g., of elastomeric material, in conductive contact with the substrate. The layer has a resistivity selective to transmit the bias voltage from the substrate to the outer periphery of the carrier surface. The layer may be covered by an outer non-conductive coating, or may be an exposed uncoated layer.

Typically, the applying means is an electrically conductive toner adder roller with a resilient surface, e.g., a foam roller or fur brush roller.

During deposition onto the developer roller by the adder roller, the toner particles and charging beads acquire small negative and positive charges, as the case may be, from physical agitation. The toner particles are then fully triboelectrically charged by relative motion of the toner particles and oppositely charged beads in the alternating field produced by the AC component of the bias voltage. The latent image is developed by the charged mixture in an electric field produced by the DC component of the bias voltage. The magnitude of the DC component of the bias voltage determines the density of the developed image.

In a preferred embodiment, a DC bias is also applied to the adder roller to provide a gradient relative to the DC component of the bias voltage applied to the developer roller, for driving the bulk charged mixture onto the developer roller. Charged toner particles are driven to the developer roller by the DC potential difference between the adder roller and developer roller. In a given case, the adder roller DC bias is more negative than the DC component of the developer roller bias.

This system differs from the prior art in that the toner is triboelectrically charged in bulk rather than by contact with adjacent surfaces. The invention thus advantageously provides greater uniformity of triboelectrical charging and reduced system sensitivity to surface contamination, e.g., scumming.

Another advantage is that a developer roller with an uncoated semiconductive, e.g., elastomeric, surface is usable, as the invention obviates the usual prior art requirement that the semiconductive surface have a non-conductive outer coating. Use of a semiconductive (resilient) elastomer as the developer roller carrier surface in contact development insures its compliance to the photoconductor (drum) surface. It also reduces image fringe fields and halo effects.

The gray scale monocomponent nonmagnetic development system of the invention contemplates both apparatus for developing an electrostatic latent image on a photosensitive surface of a photoconductor, and a cognate operating method.

The apparatus comprises electrically biasable developer means for carrying said mixture; electrically conductive applying means adjacent the developer means for applying the mixture thereto; and voltage means arranged for applying said bias voltage to the developer means. Limiting means, e.g., a conductive doctor blade, may be used to control selectively the mass per unit area (thickness) of the mixture applied to the developer means.

The cognate method, for triboelectrically charging the mixture in bulk in the apparatus to develop the latent image, comprises providing a supply of said mixture, applying it to the developer means by the applying means, and applying said bias voltage to the developer means. The AC component is selective to produce the alternating field for bulk triboelectric charging of the mixture between the applying means and developer means independently of friction contact of the mixture with surfaces of the apparatus, and the DC component is selective to produce the electric field for developing the latent image to the selective image density.

Viewed from one aspect, the present invention is directed to apparatus for developing an electrostatic latent image. The apparatus comprises biasable developer means, conductive applying means, and voltage means. The biasable developer means carries a monocomponent nonmagnetic developer comprising a mixture of toner particles triboelectrically chargeable to one polarity, and generally transparent counterpart charging beads triboelectrically chargeable to the opposite polarity, for developing the latent image. The conductive applying means is adjacent the developer means and applies the mixture thereto. The voltage means is arranged for applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means.

Viewed from another aspect, the present invention is directed to a method for triboelectrically charging in bulk a monocomponent nonmagnetic developer in apparatus having conductive applying means adjacent biasable developer means for carrying the developer for developing an electrostatic latent image on a photosensitive surface of a photoconductor. The method comprises a first step of providing a supply of monocomponent nonmagnetic developer comprising a mixture of toner particles triboelectrically chargeable to one polarity and generally transparent counterpart charging beads triboelectrically chargeable to the opposite polarity. A second step of the method is applying the mixture from the supply onto the developer means by the applying means. A third step of the method is simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
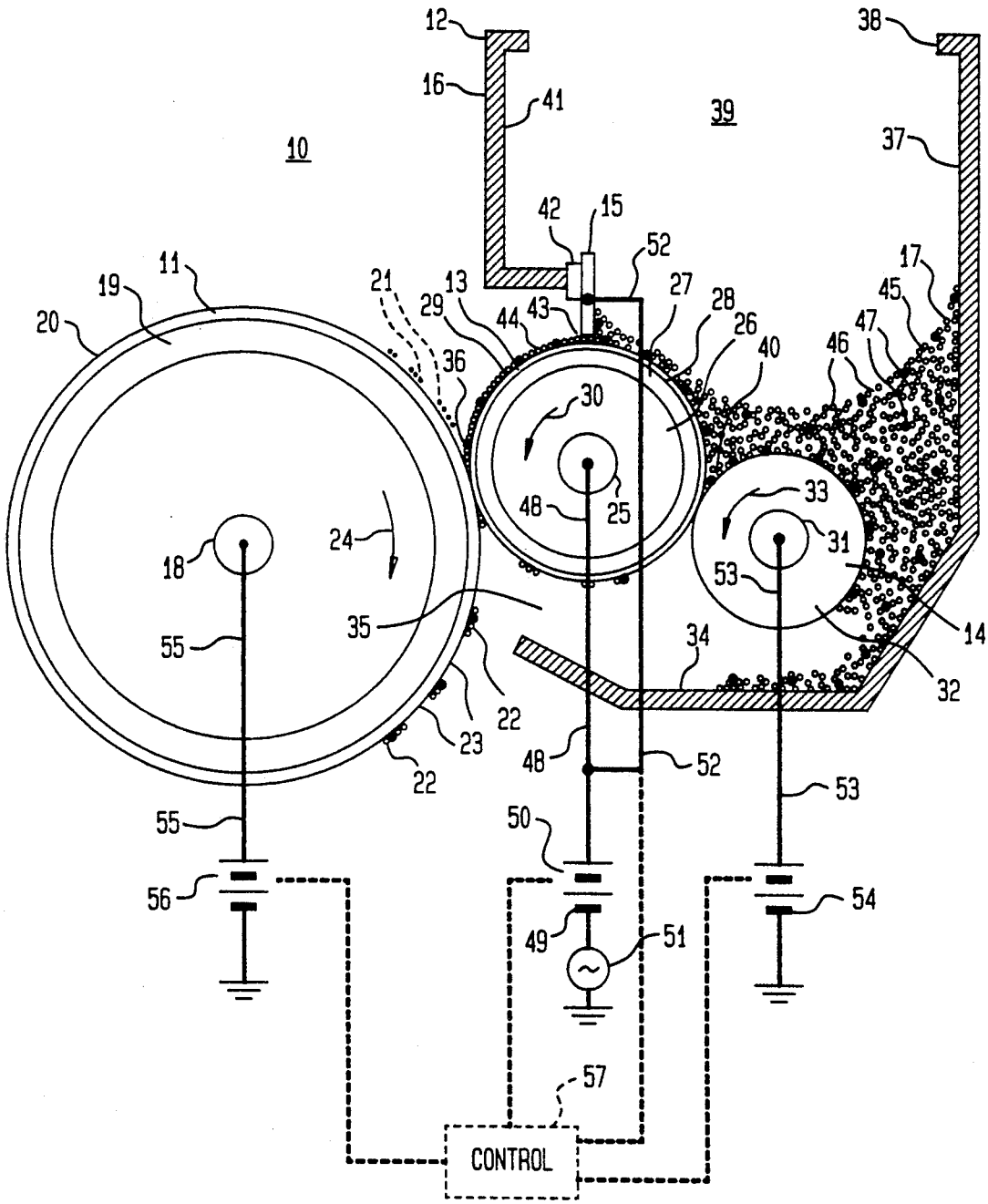
FIG. 1 is a partial sectional side view of an arrangement for developing an electrostatic latent image in accordance with an embodiment of the invention.

Referring now to FIG. 1, there is shown an electrophotographic device 10 in accordance with the present invention. Electrophotographic device 10 comprises a conventional photoconductor (drum) 11 and a developer apparatus 12. Device 10 may be operated for charge area development (CAD) as used in photocopying machines, or discharge area development (DAD) as used in laser printers.

Apparatus 12 has conventional electrically biasable developer means shown as a developer roller (sleeve) 13, conventional electrically conductive applying means shown as an adder roller 14, conventional mass per unit area (thickness) limiting means shown as an electrically conductive doctor blade 15, and a housing 16 containing a special monocomponent nonmagnetic developer (toner) 17. Apparatus 12 is used to charge toner 17 in bulk triboelectrically in an alternating field in accordance with the invention for image development in device 10.

Photoconductor 11 is rotatably mounted via a conductive shaft 18, and has a photoconductive substrate 19 and a photosensitive surface 20 providing electrostatic latent images 21 for forming toner developed images 22 in relation to undeveloped background areas 23. Photoconductor 11 is rotated (by means not shown) in a given, e.g., clockwise, direction as indicated by arrow 24.

Developer roller 13 is rotatably mounted via a conductive shaft 25, and has a conductive substrate 26 and typically a resilient semiconductive layer 27, optionally coated by an outer non-conductive coating 28, forming a carrier surface 29. Developer roller 13 is rotated (by means not shown) in the opposite direction to that of photoconductor 11, e.g., counterclockwise as indicated by arrow 30, for cocurrent travel of their adjacent peripheries.

Adder roller 14 is rotatably mounted via a conductive shaft 31, and typically has a resilient surface 32, e.g., of conductive foam material. Adder roller 14 is rotated (by means not shown) in the same or opposite direction to that of developer roller 13, e.g, in the same counterclockwise direction as indicated by arrow 33.

Housing 16 has a structural surface (wall) 34 with an opening 35 in which developer roller 13 is disposed adjacent photoconductor 11 at a developing zone 36. Developer roller 13 is shown in slight pressure contact with photoconductor 11 for contact development at developing zone 36. As it contains resilient layer 27, developer roller 13 compliantly engages photoconductor 11. However, developer roller 13 may be spaced from photoconductor 11 to form a small gap for non-contact development at developing zone 36.

Housing 16 includes a hopper portion 37 with an inlet 38 for feeding a supply of toner 17 to its interior 39. Adder roller 14 is disposed in interior 39 adjacent developer roller 13 at a charging zone 40 remote from developing zone 36. Adder roller 14 is shown in slight pressure contact with developer roller 13 for scraping contact therewith at charging zone 40. As adder roller 14 contains resilient surface 32 and developer roller 13 contains resilient layer 27, adder roller 14 compliantly engages developer roller 13. However, adder roller 14 may be spaced from developer roller 13 to form a small gap at charging zone 40 for non-contact applying of toner 17 from its supply in interior 39 by adder roller 14 to developer roller 13.

Housing 16 also includes a support portion 41 with an adjustment means 42 for adjustably mounting doctor blade 15 adjacent the periphery of developer roller 13 at a control zone 43. Control zone 43 is located intermediate developing zone 36 and charging zone 40. Doctor blade 15 serves to form a smooth toner layer 44 of selective thickness on carrier surface 29.

In accordance with a significant feature of the invention, toner 17 is formed as a special mixture 45 of toner particles 46 (shown in FIG. 1 by circles) and generally transparent counterpart charging beads 47 (shown in FIG. 1 by dots).

In accordance with another significant feature of the invention, a developer circuit 48 connects developer roller shaft 25 to ground through a developer bias voltage source 49 to provide a DC component 50 and an AC component 51 to developer roller 13. A doctor blade circuit 52 connects doctor blade 15 to ground, e.g., optionally via connection with developer circuit 48 to provide doctor blade 15 with the same DC component and AC component bias voltage as developer roller 13. An adder roller circuit 53 connects adder roller shaft 31 to ground, and optionally has an adder roller voltage source 54 to provide a bias voltage to adder roller 14. A photoconductor circuit 55 connects photoconductor shaft 18 to ground, and optionally has a photoconductor voltage source 56 to provide a DC bias to photoconductor 11. Control means 57, e.g., a central processing unit, is connected to the various voltage sources and circuits for controlling their operation.

Photoconductor 11, developer roller 13, adder roller 14 and doctor blade 15 are known parts. However, in accordance with the invention, they are used with mixture 45 in an arrangement that does not rely on friction contact of mixture 45 with adjacent surfaces of apparatus 12, i.e., contact with housing surface 34 or with adder roller 14, developer roller 13 or doctor blade 15, for triboelectrically charging toner particles 46. Instead, such charging is effected in bulk in an alternating field under applied bias voltages supplied by developer voltage source 49.

Developer roller 13 desirably has a resilient semiconductive elastomeric layer 27 with a resistivity selective to permit transmission from substrate 26 to the outer periphery of carrier surface 29 of the bias voltage applied by developer voltage source 49 to substrate 26 via developer roller shaft 25. For example, layer 27 has a hardness of about 10 to 50 Shore A and a resistivity of about $10^7$ to $5\times10^{10}$ ohm cm. Such resistivity is effective to transmit in controlled manner the bias voltage from developer voltage source 49 to the outer periphery of carrier surface 29.

According to a coated developer roller embodiment, layer 27 is coated with outer electrically non-conductive coating 28, e.g., of a few mils thickness (coated developer roller).

According to an uncoated developer roller embodiment, outer coating 28 is omitted to provide layer 27 as a directly exposed uncoated layer (uncoated developer roller).

While developer roller 13 is shown as one form of developer element or sleeve for carrying toner 17, it may be of other suitable form such as a pliable endless belt or the like. Developer roller 13 does not need attendant magnets as required for two component, or one component, magnetic type developer systems.

Substrate 26 and layer 27, and optional outer coating 28, may be provided in accordance with the teaching in U.S. Pat. No. 5,011,739 (Nielsen et al.), issued Apr. 30, 1991, the disclosure of which is incorporated herein by reference. In particular, substrate 26 may be formed of aluminum, copper or the like as a core, and layer 27 as a coating, e.g., about 0.125–0.625 inch thick, thereon of generally moisture insensitive cross linked elastomeric polyurethane containing a conductivity control agent. The conductivity control agent is present in an amount capable of altering or controlling the resistivity of the polyurethane to provide the desired resistivity level and is bonded covalently thereto to prevent its migration and provide moisture resistance.

Alternately, developer roller 13 may have a nitrile rubber layer, e.g., of butadiene-acrylonitrile copolymer, e.g. about 6 mm thick, coated with an outer coating of polyurethane, e.g. about 50 microns thick.

The surface (peripheral) speed of developer roller 13 may equal, or be faster or slower than, that of photoconductor 11.

Adder roller 14 is typically a conductive roller with a resilient surface such as a resilient foam roller as shown, or a fur brush, or even a pliable endless belt or the like.

The surface speed of adder roller 14 may equal, or be faster or slower than, that of developer roller 13.

A bias voltage may be applied to adder roller 14, such as a DC voltage applied by adder roller voltage source 54. This DC bias voltage may be the same as the DC component of the bias voltage applied to developer roller 13 by developer voltage source 49, such as for black-only printing. However, according to a further significant feature of the invention, this adder roller DC bias voltage is different from the DC component of the bias voltage applied to developer roller 13, to provide a gradient relative thereto for driving mixture 45 onto developer roller 13, such as for continuous tone color printing. For example the adder roller DC bias may be more negative than the DC component of the bias voltage applied to developer roller 13 by voltage source 49.

This adder roller bias voltage is effective to enhance deposition of charged toner particles 46 and charging beads 47 on carrier surface 29 of developer roller 13. However, bulk triboelectric charging of the two components of mixture 45 is effected by the AC component of the developer bias voltage applied to developer roller 13. The latter bias voltage provides the alternating field that fosters bulk charging of mixture 45 prior to its being applied to carrier surface 29, as discussed below.

Doctor blade 15 is typically formed of conductive material, e.g., metal, providing a toner limiting surface to limit (control) selectively the thickness of bulk charged toner layer 44 by smoothing it into a uniform layer at control zone 43. A bias voltage is optionally applied to doctor blade 15 via doctor blade circuit 56. By connecting doctor blade circuit 56 to developer circuit 48, the doctor blade bias voltage may comprise the same DC and AC components as those of the developer bias voltage provided by developer voltage source 49.

Photoconductor 11 is a conductive element typically having a photoconductor circuit 55 to ground. A bias voltage may be applied thereto by photoconductor voltage source 56 in photoconductor circuit 55. Per control means 57, the photoconductor bias voltage operates in conjunction with the bias voltage of developer voltage source 49 applied to developer roller 13, the optional bias voltage applied to doctor blade 15 via doctor blade circuit 52 and developer circuit 48, and the optional bias voltage applied to adder roller 14 by adder roller voltage source 54.

According to the invention, toner 17 is specifically constituted as a supply of a monocomponent nonmagnetic mixture 45 of nonmagnetic toner particles 46 triboelectrically chargeable to one polarity, and generally transparent, nonmagnetic counterpart charging beads 47 triboelectrically chargeable to the opposite polarity to that of toner particles 46. Charging beads 47 are specifically included in mixture 45 to achieve full triboelectric charging of toner particles 46. Thus, charging beads 47 must be capable of triboelectrically charging toner particles 46.

Charging beads 47 in monocomponent nonmagnetic developer (toner) 17 are unlike the carrier particles of two component developers formed of toner particles and magnetic carrier particles. Charging beads 47 effect full triboelectric charging of toner particles 46 in mixture 45 without magnetic carrier particles or magnetic means in the developer unit as in two component developers. In two component developer units, magnetic means are required, e.g., in the developer roller, for triboelectric charging of the toner particles by magnetic carrier particles.

Also, the carrier of a two component developer is not intended to be consumed, i.e., transferred with the toner to the latent image during development. Thus, as toner is consumed, the ratio of the toner particles to carrier particles changes. This ratio must be continuously monitored for replenishing consumed toner.

Indeed, the carrier particles should not be transferred with the toner particles to the image being developed as such disturbs the uniformity of the image density of the developed image. When half tone images or continuous tone color images are developed, contamination of the developed images and/or background areas with carrier particles can be troublesome. Carrier particles are generally opaque and partially hide the desired image color to the detriment of image quality, color tone and shading. On deposition in background areas, carrier particles result in fog.

On the other hand, charging beads 47 are at least partially consumed along with toner particles 46. As they are transparent, charging beads 47 are readily accommodated in the developed images 22 and are compatible with the given image color. Deposition of charging beads 47 in background areas 23 is inconsequential because they are the opposite charge to the toner and are not generally transferred.

As mixture 45 is a one component nonmagnetic developer, it is per se different from one component magnetic developers. Due to their content of generally opaque magnetic material, the latter developers cannot be effectively used in multicolor printing. In multicolor printing, different color toners are usually sequentially transferred to paper. Accumulation of opaque magnetic particles in a multicolor image would aggravate their adverse effect.

Mixture 45 typically contains a major proportion of image forming toner particles 46 of selective average particle size and a corresponding minor proportion of charging beads 47 of substantially smaller average particle size. Mixture 45 may be formed by dry blending toner particles 46 with charging beads 47. For instance, mixture 45 may comprise a ratio, by weight, of about 1–6 parts charging beads 47 per 100 parts toner particles 46, e.g., 3 parts charging beads 47 per 100 parts toner particles 46. Toner particles 46 may have an average size (diameter) range of about 8.15 microns, e.g., be about 12 microns in size, and charging beads 47 may have an average size (diameter) range of about 0.05–0.35 microns, e.g., be about 0.15 micron in size.

While such mixture ratio, toner particle size, and charging bead size, ranges are well suited for use according to the invention, any suitable mixture ratio, toner particle size, and charging bead size, ranges may be used so long as the objects and functions of the invention are achieved.

As only a relatively low proportion of charging beads 47 is needed for bulk triboelectric charging of toner particles 46, the amount of such beads 47 deposited in developed images 22 and/or undeveloped background areas 23 is inconsequential.

In this embodiment, toner particles 46 are provided as negatively chargeable particles and charging beads 47 as positively chargeable beads. However, toner particles 46 may be positively chargeable and charging beads 47 negatively chargeable. It is only necessary that toner particles 46 and charging beads 47 be of mutually opposite charge sign (polarity). To this end, charging beads 47 are composed of polymer material of a triboelectric character spaced in the triboelectric (electrostatic) series from that of the polymer material of toner particles 46.

Charging beads 47 may be composed of a polymer material more positive in the triboelectric series than that of toner particles 46. Thus, on triboelectrically charging mixture 45, charging beads 47 acquire a positive charge and toner particles 46 acquire a negative charge. Conversely, charging beads 47 may be composed of a polymer material more negative in the triboelectric series than that of toner particles 46. In this event, on triboelectrically charging mixture 45, charging beads 47 acquire a negative charge and toner particles 46 acquire a positive charge.

The selection of the charge sign (polarity) of toner particles 46, and concordantly of the opposite charge sign (polarity) of charging beads 47, is determined by the nature of the development operation, and particularly the charge sign (polarity) of the electrostatic latent images 21 and/or background areas 23 on photosensitive surface 20 of photoconductor 11.

For example, in charge area development (CAD), such as is used in a photocopying machine, initially photosensitive surface 20 is charged uniformly at a high charge level to positive (or negative) polarity by corona charging, such as by a corona charging device (not shown) having a corona wire and grid arrangement adjacent photoconductor 11. The charged photosensitive surface 20 is then exposed to light to replicate a pattern such as printed text on a document to be electrophotographically reproduced. While latent images 21 corresponding to the pattern remain fully positively (or negatively) charged, the charge in background areas 23 is dissipated by the light to low charge or uncharged condition.

In this case, toner particles 46 are triboelectrically charged to the opposite, i.e., negative (or positive), polarity. Toner particles 46 thus transfer from toner layer 44 on carrier surface 29 selectively to the positively (or negatively) charged latent images 21 on photosensitive surface 20 to form toner developed images 22. This is primarily due to the electrostatic attractive force at developing zone 36 between charged latent images 21 of one polarity and charged toner particles 46 of the opposite polarity. Since background areas 23 have little or no electrostatic charge, toner particles 46 are not attracted thereto during development.

Also, carrier surface 29 is charged to the same polarity as latent images 21 but at a lower charge level, so that toner particles 46 are preferentially attracted at developing zone 36 from developer roller 13 to the higher level opposite polarity charged latent images 21. This occurs under the driving force of the electric field produced by the DC component of the bias voltage applied to developer roller 13 by developer voltage source 49.

As toner particles 46 are triboelectrically charged in bulk prior to being applied onto carrier surface 29 as toner layer 44, carrier surface 29 is not charged to a high level opposite polarity charge to that of toner particles 46. On the other hand, such high level charging takes place in the prior art as the developer roller serves as carrier for triboelectric charging of toner thereagainst.

Conversely, for discharge area development (DAD), such as is used in a laser printer, on exposing such fully positively (or negatively) charged photosensitive surface 20 to light, the charge of latent images 21 corresponding to the pattern is dissipated to low charge or uncharged condition, while background areas 23 remain fully positively (or negatively) charged.

In this case, toner particles 46 are triboelectrically charged to the same, i.e., positive (or negative), polarity as photosensitive surface 20. Toner particles 46 thus transfer from toner layer 44 on carrier surface 29 selectively to the low charge or uncharged latent images 21 on photosensitive surface 20 to form toner developed images 22. This is due to the electrostatic force exerted on triboelectrically charged toner particles 46 of a given (positive or negative) polarity at developing zone 36 between discharged image areas 21 or charged background areas 23 of the same polarity and a carrier surface 29 biased at the same polarity. Toner particles 46 are repelled from background areas 23 and attracted onto latent images 21.

Carrier surface 29 is biased at the same polarity as toner particles 46 to repel them onto the latent images 21 at developing zone 36 under the driving force of the electric field produced by the DC component of the bias voltage applied to developer roller 13 by developer voltage source 49. Carrier surface 29 is not charged to the opposite polarity to that of toner particles 46 as this would hinder their transfer to the low charge or uncharged latent images 21.

Toner particles 46 may comprise a matrix (binder) of conventional toner polymer (resin) containing a suitable amount of a conventional colorant, e.g., a pigment and/or dye, and optionally a suitable amount of a conventional charge control agent. The charge control agent is selected according to the desired polarity to which toner particles 46 are to be charged and the nature of the particular toner polymer relative to that of charging beads 47. Charging beads 47 may comprise a conventional generally transparent polymer (resin), especially one having a glass transition temperature greater than 50° C. The transparent polymer of charging beads 47 is selected according to the desired polarity to which they are to be charged, i.e., the opposite of the polarity to which toner particles 46 are to be charged.

The toner polymer for toner particles 46 is generally an electrically insulative thermoplastic resin such as a styrene-acrylic copolymer, polyester polymer, and the like type conventional polymer materials. Likewise, the, e.g. essentially, transparent polymer of charging beads 47 is generally an electrically insulative, e.g., organic, material, and particularly a resin such as polymethylmethacrylate (PMMA), polystyrene, styrene-acrylic copolymer, acrylic polymer, and the like type conventional essentially transparent polymer materials. As aforesaid, the toner polymer of toner particles 46 and the transparent polymer of charging beads 47 are selected so as to be spaced apart in the triboelectric series. Also, the polymer of charging beads 47 desirably has a glass transition temperature greater than 50° C.

Particular polymer materials usable for toner particles 46 and charging beads 47 include, for example, those disclosed in U.S. Pat. No. 4,833,060 (Nair et al.), issued May 23, 1989; U.S. Pat. No. 4,835,084 (Nair et al.), issued May 30, 1989; and U.S. Pat. No. 4,965,131 (Nair et al.), issued Oct. 23, 1990, the disclosures of which are incorporated herein by reference.

An example of a negatively chargeable nonmagnetic color toner (color toner #1) is cyan ColorEdge toner (Eastman Kodak Co.), comprising a polyester binder containing an aluminum phthalocyanine pigment and a charge control agent. An example of a negatively chargeable nonmagnetic black toner (black toner #2) is a formulation comprising, by weight, 100 parts of a binder polymer, i.e., poly (styrene-co-butyl acrylate-co-divinyl benzene), 2 parts of a charge control agent (Bontron E-84, Orient Chemical Co.), and 6 parts of carbon black (Regal 300, Cabot Corp.).

An example, by weight, of a mixture of negatively chargeable nonmagnetic toner particles and positively chargeable charging beads is a mixture of said cyan toner (color toner #1), or said black toner (black toner #2), such toner particles having an average particle size of about 12 microns (i.e., by volume, 50% larger than 12 microns, and 50% smaller than 12 microns), and 3 parts of Soken MP- 1451 polymethylmethacrylate beads (Soken Chemical and Engineering Co., Japan), such beads having an average particle size of about 0.15 micron (i.e., by volume, 50% larger than 0.15 micron, and 50% smaller than 0.15 micron).

Significantly, developer roller 13 and adder roller 14 are spaced sufficiently from the adjacent housing surface 34 to avoid friction contact of mixture 45 therewith during bulk triboelectric charging of mixture 45 in the alternating field. Friction contact of mixture 45 with adjacent portions of housing surface 34 is to be avoided. It is at best non-uniform, causing consonant non-uniform charging of toner particles 46 and charging beads 47.

Instead, according to the invention, during conjoint relative rotation of developer roller 13 and adder roller 14, the supply of mixture 45 in housing hopper portion 37 is in positive feed flow contact with adder roller 14. This permits incremental portions of mixture 45 to be taken up by adder roller 14 and applied onto carrier surface 29 of developer roller 13 at charging zone 40. The taken up mixture 45 is incrementally physically agitated by the action of adder roller 14 to cause toner particles 46 to acquire an incipient charge of one polarity, e.g., to become negatively charged, and charging beads 47 to acquire an incipient charge of the opposite polarity, e.g., to become positively charged.

The incipiently charged mixture 45 is then incrementally applied by adder roller 14 to carrier surface 29. To this end, the incipiently charged mixture 45 is fully triboelectrically charged in bulk in charging zone 40 between adder roller 14 and developer roller 13 in the alternating field produced by the AC component of the bias voltage applied to developer roller 13 by developer voltage source 49. The bulk triboelectrically charged mixture 45 then deposits as toner layer 44 on carrier surface 29.

Unlike powder cloud charging of toner by particle impingement alternately against opposed electrodes, mixture 45 is charged by vigorous motion of and triboelectrical interaction between toner particles 46 and charging beads 4 in the alternating field between adder roller 14 and developer roller 13.

Developer voltage source 49 is arranged per control means 57 for applying a bias voltage to developer roller 13 having an AC component selective for producing an alternating field sufficient for triboelectrically charging mixture 45 in bulk between adder roller 14 and developer roller 13 substantially independently of friction contact of mixture 45 with the adjacent housing surface 34, or with adder roller 14, developer roller 13 or doctor blade 15. This alternating field influences individual toner particles 46 and charging beads 47 to move vigorously back and forth between adder roller 14 and developer roller 13 at charging zone 40. This vigorous action raises the mutually opposite charges being imparted to the two components of mixture 45. This occurs under the intense friction contact in bulk of the individual toner particles 46 with each other, of the individual charging beads 47 with each other, and of the toner particles 46 with the charging beads 47.

During continued rotation of developer roller 13, toner layer 44 is contacted by doctor blade 15 at control zone 43 to smooth the bulk charged toner layer 44 into a selective, uniform thickness layer on developer roller 13. As toner layer 44 is fully charged, its friction contact with doctor blade 15 has no adverse effect on the integrity, uniformity or level of the charges on mixture 45.

On further rotation of developer roller 13, the uniform thickness, fully charged toner layer 44 is carried on carrier surface 29 to developing zone 36. At developing zone 36, toner in layer 44 is transferred selectively from carrier surface 29 to latent images 21 on photosensitive surface 20 for development to form toner images 22 as earlier described.

The DC component of the bias voltage applied to developer roller 13 by developer voltage source 49 is effectively used in the development operation. This DC component is selective for producing an electric field to develop latent images 21 into toner images 22 of selective image density from bulk triboelectrically charged mixture 45 applied as toner layer 44 to carrier surface 29.

Due to their opposite polarity charges as disposed in mixture layer 44, charging beads 47 adhere to toner particles 46 and transfer at least in part therewith from carrier surface 29 to latent images 21 during development. As charging beads 47 constitute a minor portion of mixture 45, apart from their function in bulk triboelectric charging of toner particles 46, they have no disturbing influence on the development operation.

Residual toner particles 46 and charging beads 47 remaining on carrier surface 29 after development are scraped away in known manner prior to applying mixture 45 thereto in the next cycle of developer roller 13. This scraping away of residual toner particles 46 and charging beads 47 from carrier surface 29 is conveniently effected by scraping action of adder roller 14 against developer roller 14 when they are in contact. When adder roller 14 is spaced from developer roller 13, this scraping away of residual toner particles 46 and charging beads 47 is effected by other means such as a conventional discharge brush or plate scraper located in sliding contact with carrier surface 29 at a point between developing zone 36 and charging zone 40 generally diametrically opposite doctor blade 15 at control zone 43.

Such scraping action does not disturb the bulk triboelectrical charging of mixture 45 as it occurs prior to the actual triboelectrical charging of freshly supplied mixture 45.

In operation, a DC and AC bias voltage is at least applied to developer roller 13. The magnitude of the DC bias determines the density of the toner developed images 22.

For instance, discharge area development (DAD) may be effected using a negatively charged photoconductor 11, negatively charged toner particles 46, and a negatively biased carrier surface 29. The developer DC bias is set to a negative voltage between the voltage of photosensitive surface 20 of photoconductor 11, and the residual voltage of the exposed regions (latent images 21) of photosensitive surface 20. The AC bias is added to the developer DC bias and optimized for maximum development for the given toner 17 (mixture 45). In discharge area development (DAD), for latent images 21 at 0 (zero) VDC on photoconductor 11 with background areas 23 charged to −800 VDC, typically −250 VDC to −800 VDC developer bias voltage with a 1,500 VAC (1.5 KVAC) square wave (3 KV peak to peak) at 1,000 Hz (1 KHz) frequency, is applied to developer roller 13. At less than 0.5 KHz, background occurs. At greater than 2.0 KHz, density of the toned image decreases. Density also decreases at less than 0.5 KVAC. At voltages higher than 2 KVAC (4 KV peak to peak), breakdown of the elastomer (semiconductive layer 27) may occur. Conversely, for charge area development (CAD), the magnitude of the developer bias voltage is correspondingly selected relative to the charge level of the dissipated charge on the background areas 23.

The system of the invention can produce excellent black on white text images (e.g., using black toner #2), containing lines and solid areas with developer roller 13, adder roller 14 and doctor blade 15 at the same potential, using either a semiconductive developer roller 13 with a non-conductive skin (outer layer 28) or a semiconductive developer roller 13 without such an overcoat (without outer layer 28).

However, for continuous tone color printing (e.g., using color toner #1), best results are generally achieved with an uncoated semiconductive developer roller 13 (without outer layer 28), and with adder roller 14 biased at least 100 VDC more negative than the negative DC bias on developer roller 13 in the case of negatively charging toner particles 46. For positively charging toner particles 46, this voltage differential is desirably at least 100 VDC more positive than the positive DC bias on the developer roller.

The AC field of developer roller 13 and the difference in DC potential between developer roller 13 and adder roller 14 triboelectrically charges mixture 45, drives charged toner particles 46 and charged charging beads 47 onto developer roller 13, retains some charging beads 47, and removes residual charging beads 47 from developer roller 13 after development has occurred.

The DC bias on adder roller 14 has been generally found necessary to produce a uniform toner layer 44 on developer roller 13 with a toner 17 of the type that does not flow readily in powder form (e.g., color toner #1). If the DC and AC bias of developer roller 13 is also applied to adder roller 14, small clumps of toner 17 can form on developer roller 13. However, a uniform layer 44 of toner (mixture 45) is produced on developer roller 13 with relatively poorly flowing type toner if a DC bias on adder roller 14 is used which produces a gradient relative to the DC component of the bias voltage of developer roller 13, e.g., if the DC bias on adder roller 14 is at least 100 V more negative than the DC bias of developer roller 13 in the case of negatively charging toner particles 46, or at least 100 V more positive than such DC developer roller bias in the case of positively charging toner particles 46.

Thus, use of a voltage gradient between adder roller 14 and developer roller 13, i.e., a greater magnitude DC bias applied to adder roller 14 than the magnitude of the DC component of the bias voltage applied to developer roller 13, provides a differential potential for driving the bulk charged mixture 45 onto developer roller 13 while simultaneously offsetting any clumping tendency of a comparatively poor flowing type of toner particles 46.

While the functions that occur are not fully understood at this time, it is believed that the DC bias on the adder roller increases the uniformity of the toner particle charge and removes some charging beads from the toner particles deposited on the developer roller. This increases toner particle to toner particle electrostatic repulsion, thus decreasing toner particle cohesion (clumping).

A more gradual gray scale is obtained if a DC bias is applied to adder roller 14. The average toner charge is changed only slightly by the DC bias on adder roller 14, e.g, from about 5 (without such bias) to about 7 microcoulombs per gram (μC/g).

Figure 2:
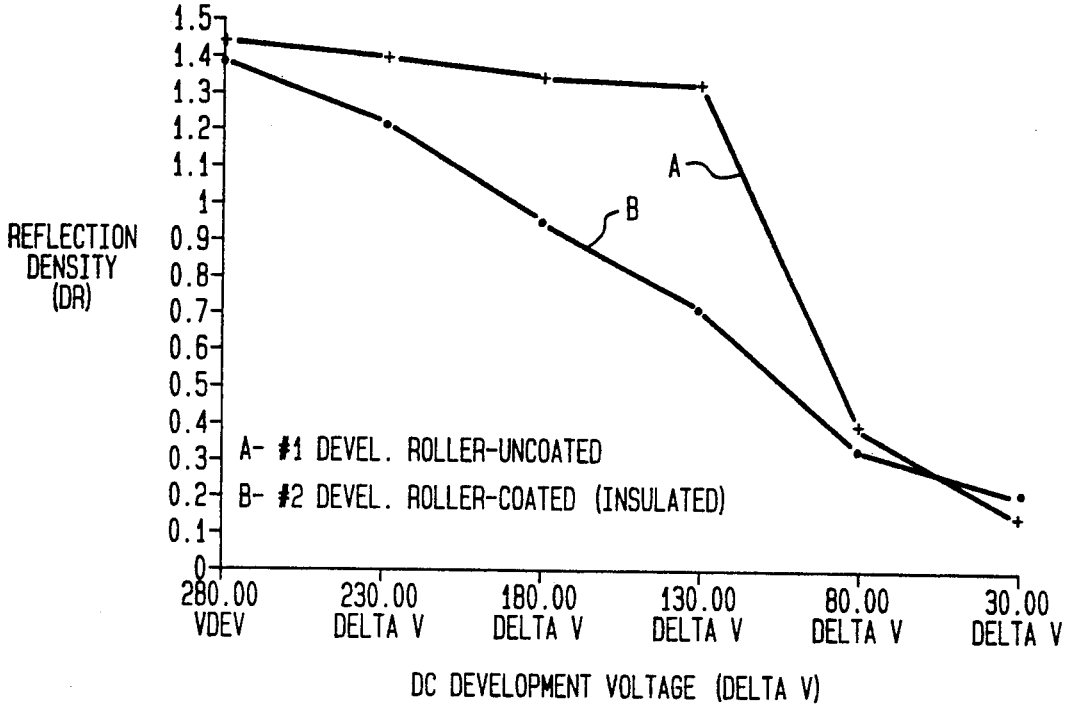
FIG. 2 is a graph showing developed image reflection density Dr as a function of DC development voltage (delta V), using the arrangement of FIG. 1 under various operating conditions.

FIG. 2 shows gray scale reflection density (Dr) as a function of DC development voltage (delta V), representing the difference between the discharged latent image voltage (DAD, laser printer) and the developer roller bias voltage (VDEV), produced under the bias conditions of a preferred embodiment of the invention. These conditions included and initial photoconductor voltage of −600 VDC, a developer roller bias voltage (VDEV) of −280 VDC and 1,500 VAC (3 KV peak to peak), at a frequency of 1,000 Hz, and a toner adder roller DC bias (TAR) of −500 VDC (no AC), in the arrangement of FIG. 1. The same developer roller bias voltage (VDEV) was also applied to the doctor blade. However, comparable results may be obtained with use of different voltage conditions for the adder roller and/or doctor blade.

Mixture 45 comprised, by weight, 100 parts of said nonmagnetic black toner #2 having an average particle size of about 12 microns as negatively chargeable toner particles 46, and 3 parts of said PMMA beads (Soken MP-1451) having an average particle size of about 0.15 micron as positively chargeable charging beads 47.

The monocomponent nonmagnetic development system (laser printer) included a conductive foam adder roller 14 [IBM model 4019], a metal doctor blade 15 [IBM model 4019], and a photoconductor 11 [Kodak] having a capacitance of approximately 1.5 microfarads per square meter. Depending on the given test, it also included:

(A) a first uncoated polyurethane developer roller 13 having a 0.275 inch thick semiconductive layer 27 with a resistivity of $2\times10^8$ ohm cm (without outer layer 28), designated developer roller #1; or (B) a second [IBM model 4019] semiconductive, coated developer roller 13 having a core resistivity of $10^8$ to $10^9$ ohm cm with a 50 micron non-conductive coating (outer layer 28), designated developer roller #2.

The stated VDEV bias voltage was applied to the given developer roller 13 and to the doctor blade 15, while the stated TAR bias voltage was applied to the adder roller 14. The electric field and DC potential difference between the given developer roller 13 and adder roller 14 in this preferred embodiment of the invention triboelectrically charged mixture 45 in bulk and effected deposition of the charged mixture onto carrier surface 29 of the given developer roller 13 for contact developing of the discharged latent image on the photoconductor 11. The photoconductor to developer roller to adder roller (opposite direction) surface (peripheral) speed ratio was 1:1:−0.7, with the photoconductor 11 running at exactly 2 inches/second peripheral speed. The doctor blade was under a loading force of 864 grams (37.2 g/cm).

As shown in FIG. 2, per (A), the uncoated developer roller #1 produced grays from 1.4 Dr (reflection density) to 0 (zero) Dr over an approximately 200 V (230 to 30) development delta V range, and reduced halo image effects. Delta V is the DC voltage of the discharged latent image on photoconductor 11 minus the DC component of the bias voltage applied to developer roller 13 (e.g., 230 delta V = −50 VDC discharged latent image minus −280 VDC developer roller DC bias component; and 30 delta V = −250 VDC discharged latent image minus −280 VDC developer roller DC bias component).

Per (B), the coated developer roller #2 produced a more gradual gray scale, but is undesirable for a color printer (laser printer) because it produces a white halo around black solid images on gray background areas.

Gray scale image densities produced by both the uncoated developer roller #1 and the coated developer roller #2 under the bias conditions of this preferred embodiment are acceptable. However, the uncoated developer roller #1 is preferred as it reduces fringe development and halo effect for either gray on white or black on gray images.

Based on the fact that an electric field is always normal to the surface of a perfect conductor, image fringe field effects, such as halo, are considered to be minimized with a highly conductive developer roller 13 in contact with photosensitive surface 20 of photoconductor 11. For this reason, the uncoated developer roller 13 is preferred. Use of an elastomer (resilient) surface on this developer roller 13 insures its compliance with photoconductor 11 in contact development.

It is clear that triboelectrical charging "in the bulk" occurs since the system works with either an uncoated semiconductive elastomer developer roller 13 (without outer layer 28), per developer roller #1, or a developer roller 13 with a non-conductive coating (outer layer 28), per developer roller #2. This demonstrates that bulk triboelectric charging according to the invention is not sensitive to developer roller surface conditions.

Figure 3:
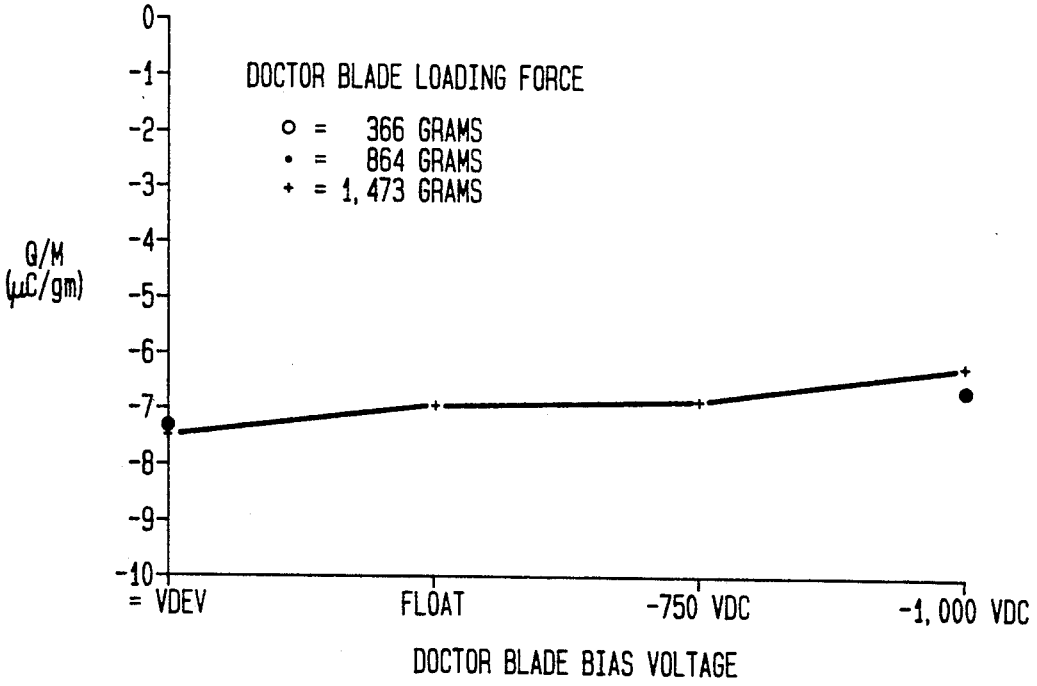
FIG. 3 is a graph showing toner charge to mass ratio (Q/M) for various doctor blade voltages and loading forces, using the arrangement of FIG. 1.

FIG. 3 shows further evidence that bulk triboelectric charging of the toner occurs under similar conditions in the arrangement of FIG. 1. Toner charge to mass ratio (Q/M) in microcoulombs per gram (μC/gm) are given for various doctor blade loading forces and bias voltages (DC and AC, and DC only), at a given developer roller bias voltage (VDEV) and a given adder roller bias voltage (TAR). The data show that bulk triboelectric charging according to the invention does not depend on doctor blade bias or the pressure of the doctor blade on the developer roller. These data were obtained with an initial photoconductor voltage of −800 VDC, a developer roller bias voltage (VDEV) of −750 VDC and 1,500 VAC (3 KV peak to peak), at a frequency of 1,000 Hz, and an adder roller bias voltage (TAR) of −1,000 VDC (no AC).

Development was conducted per FIG. 3 in the same manner as per FIG. 2, using the uncoated developer roller #1 in the arrangement of FIG. 1, with the doctor blade:

(D) at the same said bias voltage as the developer roller (VDEV), using a loading force of 366 grams (15.8 g/cm), 864 grams (37.2 g/cm) and 1,473 grams (63.5 g/cm), respectively;

(E) at "float" condition, i.e., in electrically disconnected condition, using a loading force of 1,473 grams;

(F) at −750 VDC (no AC), using a loading force of 1,473 grams; and (G) at −1,000 VDC (no AC), using a loading force of 366 grams, 864 grams and 1,473 grams, respectively.

By extrapolation, it is clear that the results per (E) and (F), using a loading force of 1,473 grams, are consistent with those per (D) and (G), using three different loading forces.

For the conditions of the preferred embodiment of the invention, using said uncoated developer roller 13 (without outer layer 28), FIG. 3 shows that toner charge to mass ratio (Q/M) is independent of the voltage bias or contact pressure of doctor blade 15. Thus, the toner does not acquire charge from doctor blade 15, demonstrating that the triboelectric charging process that occurs herein is not sensitive to doctor blade bias or the conditions, e.g., contact pressure, of the doctor blade surface.

Figure 4:
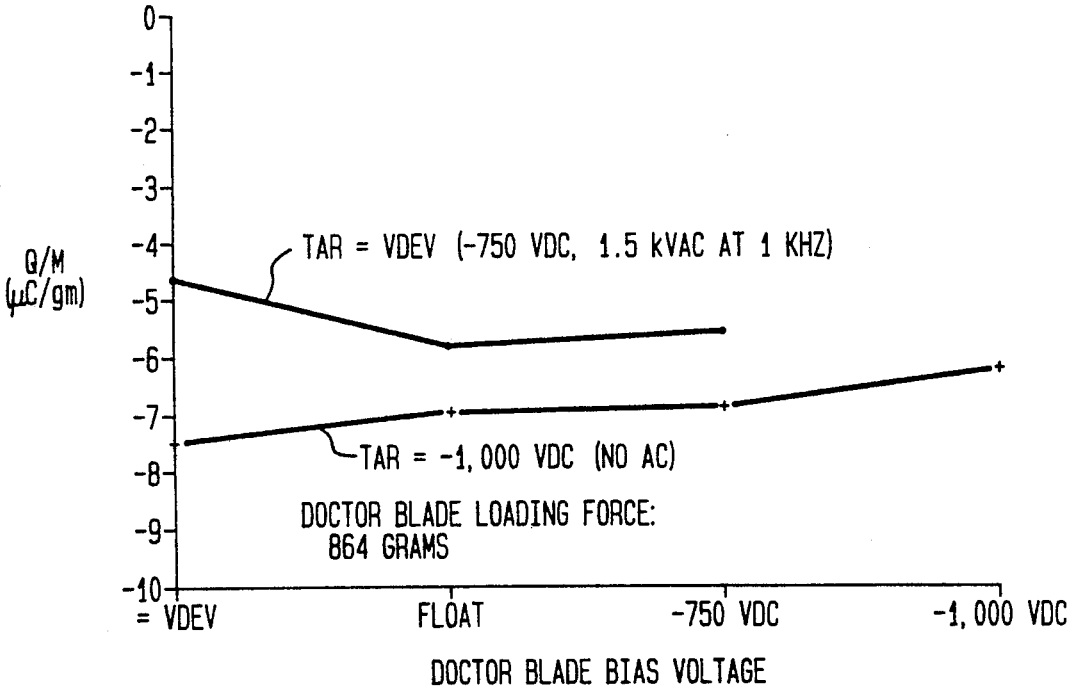
FIG. 4 is a graph similar to FIG. 3, showing the effect of a biased adder roller on the toner charge to mass ratio.

FIG. 4 shows the effect of the DC bias of adder roller 14 on the toner charge to mass ratio (Q/M). The toner charge to mass ratio was obtained for various doctor blade bias voltages at one doctor blade loading force, with the adder roller biased:

(H) at −1,000 VDC (no AC); and (I) at the same bias as the developer roller (VDEV).

Specifically, per FIG. 4, toner charge to mass ratio (Q/M) data in microcoulombs per gram (μC/gm) are given for various doctor blade bias voltages at an 864 gram loading force. These data were obtained under the same conditions (and with the same rollers and doctor blade) as in the case of FIG. 3, per (D), (E), (F) and (G), as the case may be, except for use of one loading force. Thus, like those of FIG. 3, the data in the case of FIG. 4 were obtained with a photoconductor initial voltage of −800 VDC, and a developer roller bias voltage (VDEV) of −750 VDC and 1,500 VAC (3 KV peak to peak), at a frequency of 1,000 Hz.

However, in regard to the results shown in FIG. 4, in the set of (H) instances, according to the (D), (E), (F) and (G) doctor blade bias voltages, respectively, the adder roller bias voltage (TAR) was 1,000 VDC (no AC), while in the set of (I) instances, according to only the (D), (E) and (F) doctor blade bias voltages, respectively, the TAR was at the same bias as the developer roller bias (VDEV), i.e., −750 VDC and 1,500 VAC (3 KV peak to peak), at a frequency of 1,000 Hz.

Although in the (I) set of instances, the doctor blade was not tested per the (G) doctor blade bias voltage, i.e., at −1,000 VDC, it is clear by extrapolation that these results are consistent with the (H) set of instances.

For the conditions of the preferred embodiment using an uncoated developer roller 13 (without outer layer 28), FIG. 4 shows that toner charge is greater (i.e., more negative per negative charging toner particles 46) if a differential DC bias is applied to adder roller 14 than if the same DC and AC bias is applied to adder roller 14 and developer roller 13. The higher Q/M for the −1,000 VDC (no AC) adder roller bias shown in FIG. 4 demonstrates that toner charge is sensitive to the state of, i.e., dependent on the conditions of, the adder roller/developer roller interface.

Given the above results, it is clear that although the DC and AC bias voltage applied to developer roller 13 may also be applied to doctor blade 15, this expedient may be omitted, such that doctor blade 15 remains at "float" condition, i.e., at zero bias as an electrically disconnected electrode.

While the test data obtained per FIGS. 2, 3 and 4, as the case may be, were obtained with a negatively charging black toner (black toner #2), equally good results are obtainable with 100 parts of a negatively chargeable color toner (color toner #1), e.g., of 12 micron average particle size admixed with 3 parts of said PMMA charging beads of 0.15 average particle size, as well as with a positively chargeable black or given color toner, e.g. in admixture with negatively chargeable beads in the same ratio.

Also, while the above tests were carried out with a voltage bias of 1,500 VAC at 1,000 Hz frequency, any suitable magnitude AC bias voltage and frequency, and concordant amplitude, may be used for developer roller 13, and optionally for adder roller 14, which is generally optimized for the given toner particles 46 for desired maximum development (developed image density, Dr) of latent images 21. This is selected in conjunction with the DC component of the developer roller bias voltage (VDEV), whose magnitude is selected, relative to the charge on latent images 21 in charge area development (CAD) or to the discharged level of the charge on latent images 21 in discharge area development (DAD), for desired maximum image development.

Thus, the AC component and DC component of the developer roller bias voltage may be selected from any suitable corresponding ranges consonant with the foregoing. For example, the AC component may be about 500 to 2,000 VAC at about 500 to 2,000 Hz, and the DC component may have a magnitude of about 100 to 800 VDC, depending on the particular characteristics of the toner particles 46, photoconductor 11, developer roller 13, and adder roller 14, the latent image charge level and background charge level, and the contact or non-contact nature of the development used. While the bias voltage applied to the adder roller may be the same as the developer roller bias voltage, especially for black toner particles, in the stated preferred embodiment the bias voltage applied to the adder roller comprises a DC voltage that provides a gradient relative to the DC component of the developer roller bias sufficient for enhanced driving of the toner particles to the developer roller. Such gradient is typically at least about 100 VDC.

Of course, while the magnitudes of such DC bias voltages are selected as discussed above, the sign (polarity) of such DC bias voltages will depend on the sign (polarity) to which the given toner particles are to be triboelectrically charged in bulk, as stated, and the consonant developing technique, i.e., charge area development (CAD) or discharge area development (DAD).

According to the present invention, the combination of mixture 45, developer roller 13, adder roller 14 and bias voltages as discussed above advantageously permit use of monocomponent nonmagnetic development in a continuous tone color (multicolor) printer. This eliminates the problems encountered in the prior art using known systems for a continuous tone printer, particularly for printing high density solid areas on light density backgrounds.

The present invention thus overcomes the usual problems of:

(a) White halo surrounding black solids on gray backgrounds.

(b) Dark fringe or edge development of gray solids on white backgrounds, caused by image fringe fields. Use of moderate contrast and a semiconductive compliant developer roller eliminate the halo defect for black on gray images and fringe development for gray solids.

(c) Double printing of black images in gray background areas, caused by developer roller/photoconductor speed difference as normally required to eliminate background. Use of mixture 45 and the foregoing process voltages eliminate the background problem by producing a narrower charge to mass ratio (Q/M). This permits operating the developer roller and photoconductor at a 1:1 surface speed ratio, and eliminates the double printing effect.

(d) High contrast reflection density (Dr) versus development delta voltage (delta V) characteristics, as caused by cooperative development resulting from toner cohesion. Use of mixture 45 and the foregoing process voltages result in uniform toner charge and reduced toner particle cohesion, thus reducing the cooperative development effect.

Bulk triboelectric charging according to the invention results in more uniform triboelectric charging of toner. The toner charge to mass ratio has a narrower population distribution, resulting in reduced background, improved transfer and reduced cleaning problems. Process throughput is increased due to more rapid and efficient triboelectric charging of the toner. This permits greater mass per unit area densities of toner on the developer roller, increasing the maximum image density obtainable at a given running speed. Also, sensitivity of triboelectric charging to surface properties and surface contamination is reduced.

The present invention thus makes possible effective use of a gray level printer or continuous tone color printer, e.g. laser printer, with a monocomponent nonmagnetic developer system. While the above tests were effected by way of contact development, non-contact development is equally usable, such as at a development gap spacing of about 5–15, e.g., 10, mils. Also, while the above tests were performed with the adder roller in slight pressure contact with the developer roller, use of an adder roller in spaced relation to the developer roller is equally contemplated, such as at a toner applying gap spacing of about 5–15, e.g., 10, mils.

Accordingly, it can be appreciated that the specific embodiments described are merely illustrative of the general principles of the invention. Various modifications may be provided consistent with the principles set forth.

What is claimed is:

1. Apparatus for developing an electrostatic latent image, the apparatus comprising:

biasable developer means arranged for movement for carrying a monocomponent nonmagnetic developer comprising a mixture of toner particles triboelectrically chargeable to one polarity, and generally transparent counterpart charging beads triboelectrically chargeable to the opposite polarity, for developing the latent image;

conductive applying means adjacent the developer means and arranged for movement for applying the mixture thereto from a supply of the mixture in feed contact with the applying means; and voltage means arranged for applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means.

2. The apparatus of claim 1 wherein the voltage means is arranged for applying a DC bias voltage to the applying means providing a gradient relative to the DC component of the bias voltage applied to the developer means, for driving the bulk charged mixture onto the developer means.

3. The apparatus of claim 1 further comprising limiting means arranged for selectively controlling the mass per unit area of the bulk charges mixture applied to the developer means.

4. The apparatus of claim 1 wherein the developer means comprises a conductive substrate covered by a carrier surface comprising a semiconductive layer in conductive contact with the substrate and having a resistivity selective for permitting transmission of the bias voltage from the substrate to the outer periphery of the carrier surface.

5. An arrangement for developing an electrostatic latent image, the arrangement comprising:

a supply of monocomponent nonmagnetic developer comprising a mixture of a major proportion of image forming toner particles of selective particle size and triboelectrically chargeable to one polarity, and a corresponding minor proportion of generally transparent counterpart charging beads of substantially smaller particle size than the toner particles and triboelectrically chargeable to the opposite polarity;

biasable developer means for carrying the mixture, for developing the latent image;

conductive applying means adjacent the developer means for applying the mixture thereto; and voltage means arranged for applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means.

6. The arrangement of claim 5 wherein the applying means is arranged for incrementally physically agitating the mixture to cause the toner particles to acquire an incipient charge of one polarity and the charging beads to acquire an incipient charge of the opposite polarity for applying the mixture to the developer means as an incipiently charged mixture, and the applying means and developer means are arranged for fully triboelectrically charging in bulk the incipiently charged mixture being applied to the developer means by the applying means in the alternating field produced by the AC component of the bias voltage.

7. The arrangement of claim 5 wherein the mixture comprises, by weight, about 1–6 parts of charging beads per 100 parts of toner particles.

8. The arrangement of claim 5 wherein the toner particles have an average size of about 8–15 microns and the charging beads have an average size of about 0.050–0.35 microns.

9. The arrangement of claim 5 wherein the toner particles comprise a matrix of thermoplastic toner polymer containing a colorant and optionally a charge control agent, and the charging beads comprise an essentially transparent polymer having a glass transition temperature greater than 50° C.

10. The arrangement of claim 5 wherein the toner particles are negatively chargeable and the charging beads are positively chargeable.

11. The arrangement of claim 5 wherein the voltage means is arranged for applying a DC bias voltage to the applying means providing a gradient relative to the DC component of the bias voltage applied to the developer means, for driving the bulk charged mixture onto the developer means.

12. The arrangement of claim 5 further comprising limiting means for selectively controlling the mass per unit area of the mixture applied to the developer means.

13. The arrangement of claim 5 wherein the developer means comprises a conductive substrate covered by a carrier surface comprising a semiconductive layer in conductive contact with the substrate and having a resistivity selective for permitting transmission of the bias voltage from the substrate to the outer periphery of the carrier surface.

14. The arrangement of claim 13 wherein the semiconductive layer has a resistivity of about $10^7$ to $5\times10^{10}$ ohm cm.

15. The arrangement of claim 13 wherein the semiconductive layer is resilient and is coated with an outer non-conductive coating.

16. The arrangement of claim 13 wherein the semiconductive layer is an exposed uncoated resilient layer.

17. An arrangement for developing an electrostatic latent image, the arrangement comprising:

a photoconductor having a photosensitive surface for providing an electrostatic latent image;

a supply of monocomponent nonmagnetic developer comprising a mixture of a major proportion of image forming toner particles of selective particle size and triboelectrically chargeable to one polarity, and a corresponding minor proportion of generally transparent counterpart charging beads of substantially smaller particle size than the toner particles and triboelectrically chargeable to the opposite polarity;

electrically biasable developer means for carrying the mixture and arranged for developing the latent image on the photosensitive surface;

electrically conductive applying means adjacent the developer means for applying the mixture thereto;

voltage means arranged for applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

said voltage means being further arranged for applying a DC bias voltage to the applying means providing a gradient relative to the DC component of the bias voltage applied to the developer means, for driving the bulk charged mixture onto the developer means; and limiting means for selectively controlling the mass per unit area of the mixture applied to the developer means.

18. A method for triboelectrically charging in bulk a monocomponent nonmagnetic developer in apparatus having conductive applying means adjacent biasable developer means for carrying the developer for developing an electrostatic latent image on a photosensitive surface of a photoconductor, the method comprising the steps of:

providing in feed contact with the applying means a supply of monocomponent nonmagnetic developer comprising a mixture of toner particles triboelectrically chargeable to one polarity and generally transparent counterpart charging beads triboelectrically chargeable to the opposite polarity;

applying the mixture from the supply onto the developer means by the applying means; and simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means.

19. The method of claim 18 further comprising incrementally physically agitating the mixture by the applying means to cause the toner particles to acquire an incipient charge of one polarity and the charging beads to acquire an incipient charge of the opposite polarity for applying the mixture to the developer means as an incipiently charged mixture, and fully triboelectrically charging in bulk the incipiently charged mixture being applied to the developer means by the applying means in the alternating field produced by the AC component of the bias voltage.

20. The method of claim 18 further comprising simultaneously applying a DC bias voltage to the applying means providing a gradient relative to the DC component of the bias voltage applied to the developer means, for driving the bulk charged mixture onto the developer means.

21. The method of claim 20 further comprising limiting the mass per unit area of the bulk charged mixture applied to the developer means by smoothing the mixture into a substantially uniform, selective thickness layer on the developer means.

22. A method for triboelectrically charging in bulk a monocomponent nonmagnetic developer in apparatus having conductive applying means adjacent biasable developer means for carrying the developer for developing an electrostatic latent image on a photosensitive surface of a photoconductor, the method comprising the steps of:

providing a supply of monocomponent nonmagnetic developer comprising a mixture of toner particles triboelectrically chargeable to one polarity and generally transparent counterpart charging beads triboelectrically chargeable to the opposite polarity;

applying the mixture from the supply onto the developer means by the applying means; and simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means; and further comprising simultaneously applying a DC bias voltage to the applying means providing a gradient relative to the DC component of the bias voltage applied to the developer means, for driving the bulk charged mixture onto the developer means; and further comprising limiting the mass per unit area of the bulk charged mixture applied to the developer means by smoothing the mixture into a substantially uniform, selective thickness layer on the developer means;

wherein the developer means comprises an exposed uncoated, resilient semiconductive layer onto which the bulk charged mixture is applied and which is in contact with the photosensitive surface of the photoconductor, and further comprising developing the latent image with the bulk charged mixture on the semiconductor layer.

23. A method for triboelectrically charging in bulk a monocomponent nonmagnetic developer in apparatus having conductive applying means adjacent biasable developer means for carrying the developer for developing an electrostatic latent image on a photosensitive surface of a photoconductor, the method comprising the steps of:

providing a supply of monocomponent nonmagnetic developer comprising a mixture of toner particles triboelectrically chargeable to one polarity and generally transparent counterpart charging beads triboelectrically chargeable to the opposite polarity;

applying the mixture from the supply onto the developer means by the applying means; and simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

wherein the mixture comprises a major proportion of image forming toner particles of selective particle size and a corresponding minor proportion of charging beads of substantially smaller particle size than the toner particles.

24. The method of claim 23 wherein the mixture comprises, by weight, about 1–6 parts of charging beads per 100 parts of toner particles.

25. The method of claim 23 wherein the toner particles have an average size of about 8–15 microns and the charging beads have an average size of about 0.05–0.35 microns.

26. A method for triboelectrically charging in bulk a monocomponent nonmagnetic developer in apparatus having conductive applying means adjacent biasable developer means for carrying the developer for developing an electrostatic latent image on a photosensitive surface of a photoconductor, the method comprising the steps of:

providing a supply of monocomponent nonmagnetic developer comprising a mixture of toner particles triboelectrically chargeable to one polarity and generally transparent counterpart charging beads triboelectrically chargeable to the opposite polarity;

applying the mixture from the supply onto the developer means by the applying means; ad simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

wherein the toner particles comprise a matrix of thermoplastic toner polymer containing a colorant and optionally a charge control agent, and the charging beads comprise an essentially transparent polymer having a glass transition temperature greater than 50° C.

27. The method of claim 18 wherein the toner particles are negatively chargeable and the charging beads are positively chargeable.

28. A method for developing an electrostatic latent image on a photosensitive surface of a photoconductor with a monocomponent nonmagnetic developer in apparatus having conductive applying means adjacent biasable developer means for carrying the developer for developing the latent image, the method comprising the steps of:

providing in positive feed flow contact with the applying means a supply of monocomponent nonmagnetic developer comprising a mixture of a major proportion of image forming toner particles of selective particle size and triboelectrically chargeable to one polarity, and a corresponding minor proportion of generally transparent counterpart charging beads of substantially smaller particle size than the toner particles and triboelectrically chargeable to the opposite polarity;

applying the mixture from the supply onto the developer means by the applying means;

simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

simultaneously applying a DC bias voltage to the applying means providing a gradient relative to the DC component of the bias voltage applied to the developer means, for driving the bulk charged mixture onto the developer means;

limiting the mass per unit area of the bulk charged mixture applied to the developer means by smoothing the mixture into a substantially uniform, selective thickness layer on the developer means; and developing the latent image with the bulk charged mixture on the developer means.

29. The method of claim 28 further comprising incrementally physically agitating the mixture by the applying means to cause the toner particles to acquire an incipient charge of one polarity and the charging beads to acquire an incipient charge of the opposite polarity for applying the mixture to the developer means as an incipiently charged mixture, and fully triboelectrically charging in bulk the incipiently charged mixture being applied to the developer means by the applying means in the alternating field produced by the AC component of the bias voltage.

30. The method of claim 28 wherein the mixture comprises, by weight, about 1–6 parts of charging beads per 100 parts of toner particles.

31. A method for developing an electrostatic latent image on a photosensitive surface of a photoconductor with a monocomponent nonmagnetic developer in apparatus having conductive applying means adjacent biasable developer means for carrying the developer for developing the latent image, the method comprising the steps of:

providing a supply of monocomponent nonmagnetic developer comprising a mixture of a major proportion of image forming toner particles of selective particle size and triboelectrically chargeable to one polarity, and a corresponding minor proportion of generally transparent counterpart charging beads of substantially smaller particle size than the toner particles and triboelectrically chargeable to the opposite polarity;

applying the mixture from the supply onto the developer means by the applying means;

simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

simultaneously applying a DC bias voltage to the applying means providing a gradient relative to the DC component of the bias voltage applied to the developer means, for driving the bulk charged mixture onto the developer means;

limiting the mass per unit area of the bulk charged mixture applied to the developer means by smoothing the mixture into a substantially uniform, selective thickness layer on the developer means; and developing the latent image with the bulk charged mixture on the developer means;

wherein the mixture comprises, by weight, about 1–6 parts of charging beads per 100 parts of toner particles; and wherein the toner particles have an average size of about 8–15 microns and the charging beads have an average size of about 0.05–0.35 microns.

32. A method for developing an electrostatic latent image on a photosensitive surface of a photoconductor with a monocomponent nonmagnetic developer in apparatus having conductive applying means adjacent biasable developer means for carrying the developer for developing the latent image, the method comprising the steps of:

providing a supply of monocomponent nonmagnetic developer comprising a mixture of a major proportion of image forming toner particles of selective particle size and triboelectrically chargeable to one polarity, and a corresponding minor proportion of generally transparent counterpart charging beads of substantially smaller particle size than the toner particles and triboelectrically chargeable to the opposite polarity;

applying the mixture form the supply onto the developer means by the applying means;

simultaneously applying to the developer means a bias voltage having an AC component selective for producing an alternating field for triboelectrically charging the mixture in bulk between the applying means and developer means substantially independently of friction contact of the mixture with any surfaces of the apparatus, and a DC component selective for producing an electric field for developing the latent image to a selective image density with the bulk charged mixture applied to the developer means;

simultaneously applying a DC bias voltage to the applying means providing a gradient relative to the DC component of the bias voltage applied to the developer means, for driving the bulk charged mixture onto the developer means;

limiting the mass per unit area of the bulk charged mixture applied to the developer means by smoothing the mixture into a substantially uniform, selective thickness layer on the developer means; and developing the latent image with the bulk charged mixture on the developer means;

wherein the mixture comprises, by weight, about 1–6 parts of charging beads per 100 parts of toner particles; and wherein the toner particles comprise a matrix of thermoplastic toner polymer containing a colorant and optionally a charge control agent, and the charging beads comprise an essentially transparent polymer having a glass transition temperature greater than 50° C.

33. The method of claim 28 wherein the toner particles are negatively chargeable and the charging beads are positively chargeable.

* * * * *